US007909324B2

(12) United States Patent
Miyake et al.

(10) Patent No.: US 7,909,324 B2
(45) Date of Patent: Mar. 22, 2011

(54) SHEET CONVEYING SYSTEM, CONTROL METHOD THEREFOR, CONTROL PROGRAM FOR IMPLEMENTING THE METHOD, AND STORAGE MEDIUM STORING THE PROGRAM

(75) Inventors: Toshiyuki Miyake, Toride (JP); Mitsuhiko Sato, Kashiwa (JP); Ichiro Sasaki, Toride (JP); Manabu Yamauchi, Kashiwa (JP); Naoto Watanabe, Abiko (JP); Akinobu Nishikata, Kashiwa (JP); Takayuki Fujii, Tokyo (JP); Hidenori Sunada, Toride (JP); Shunsuke Nishimura, Toride (JP); Takashi Yokoya, Kashiwa (JP)

(73) Assignee: Canon Kabushiki Kaisha (JP)

( * ) Notice: Subject to any disclaimer, the term of this patent is extended or adjusted under 35 U.S.C. 154(b) by 338 days.

(21) Appl. No.: 11/468,459

(22) Filed: Aug. 30, 2006

(65) Prior Publication Data

US 2007/0057445 A1 Mar. 15, 2007

(30) Foreign Application Priority Data

Aug. 31, 2005 (JP) ..... 2005-252343

(51) Int. Cl.
*B65H 7/02* (2006.01)

(52) U.S. Cl. ..... 271/258.01; 271/256

(58) Field of Classification Search ..... 271/256, 271/258.01, 259
See application file for complete search history.

(56) References Cited

U.S. PATENT DOCUMENTS 5,678,123 A * 10/1997 Kim ..... 399/21
6,598,869 B2 * 7/2003 Johnson et al. ..... 271/3.15
2003/0222396 A1 * 12/2003 Kurahashi et al. ..... 271/207
2004/0114155 A1 * 6/2004 Kurahashi et al. ..... 358/1.1

FOREIGN PATENT DOCUMENTS

JP 2004-058354 A 2/2004

* cited by examiner

*Primary Examiner* — Stefanos Karmis
*Assistant Examiner* — Michael C McCullough
(74) *Attorney, Agent, or Firm* — Rossi, Kimms & McDowell LLP

(57) ABSTRACT

A sheet conveying system which is capable of preventing a jammed sheet from being mixed with processed sheets, reducing waste in sheets and toners, and further alleviating the user's operations, when jamming has occurred during passing of a sheet between respective sheet conveying devices of upstream and downstream apparatuses. A puncher control section of a puncher as an upstream apparatus of the system issues a passing completion notification as to the passing of a sheet to a staple stacker control section of a staple stacker as a downstream apparatus of the system. Upon reception of the notification, when the staple stacker control section determines that the parameter of auxiliary information of the notification indicates an abnormal discharge of the sheet from the puncher, the staple stacker stops the conveyance of the sheet.

6 Claims, 11 Drawing Sheets

SHEET CONVEYING SYSTEM, CONTROL METHOD THEREFOR, CONTROL PROGRAM FOR IMPLEMENTING THE METHOD, AND STORAGE MEDIUM STORING THE PROGRAM

BACKGROUND OF THE INVENTION

1. Field of the Invention

The present invention relates to a sheet conveying system and a control method therefor as well as a control program and a storage medium, and more particularly to a sheet conveying system including respective sheet conveying devices of an image forming apparatus, such as a copying machine, a printer, or a facsimile, and sheet post-processing apparatuses, such as a finisher, a stacker, and a bookbinding apparatus, and a control method therefor as well as a control program for implementing the method and a storage medium storing the program.

2. Description of the Related Art

In a sheet conveying device for an image forming apparatus, when a sheet passes between two sensors arranged in a conveying path of the sheet conveying device, unless the sheet passes one of the sensors before a predetermined time period elapses after passing the other, or unless one of the sensors detects the absence of the sheet before a predetermined time period elapses after the sensor has detected the presence of the sheet, it is determined that jamming has occurred.

When such jamming has occurred, the image forming apparatus suspends all operations of the image forming process, displays on a display section a location where the jamming has occurred and a method of coping with the jamming, requests the user to carry out an operation for removing the jammed sheet, and resumes the suspended operations of the image forming process after detection of removal of the jammed sheet.

When the sheet is passed from a sheet conveying device of an image forming apparatus (upstream apparatus) to a sheet conveying device of a sheet post-processing apparatus (downstream apparatus), if jamming has occurred in the upstream apparatus, the upstream apparatus stops the conveyance of the sheet, but a jammed sheet, which has entered the downstream apparatus, is sometimes drawn out from the upstream apparatus by conveying rollers of the downstream apparatus. In this case, the downstream apparatus conveys the drawn-out jammed sheet as it is to a designated conveyance destination of processed sheets.

The upstream apparatus determines that the jammed sheet has been removed by the removal operation 0of the user, and resumes the image forming process by forming an image on a sheet corresponding to the jammed sheet. In actuality, however, the sheet corresponding to the jammed sheet has been stacked e.g. on an intermediate tray as one of the processed sheets, and hence if the image forming process is immediately resumed, another sheet corresponding to the jammed sheet is mixed with the processed sheets.

To avoid the above inconvenience, there have been proposed a method of rejecting all the processed sheets having a jammed sheet mixed therewith, discharging the entire sheet bundle into another stack tray, and resuming the image forming process from a first sheet of the sheet bundle (see e.g. Japanese Laid-Open Patent Publication (Kokai) No. 2004-058354), and a method of causing the user to eliminate a jammed sheet stacked on an intermediate tray.

The first-mentioned conventional techniques, however, rejects all the stacked sheets of the bundle having the jammed sheet mixed therewith, and resumes the image forming process from the first sheet of the bundle, so that the image forming process has to be carried out on an increased number of sheets in a duplicating manner, which increases waste in time as well as resources, such as sheets and toners.

Further, in the second-mentioned conventional technique, since the sheet bundle stacked on the intermediate tray is held by registration plates and rollers, it is difficult for the user to remove the jammed sheet alone without displacing the bundle.

SUMMARY OF THE INVENTION

It is an object of the present invention to provide a sheet conveying system which is capable of preventing a jammed sheet from being mixed with processed sheets, reducing waste in sheets and toners, and further alleviating the user's operations, when jamming has occurred during passing of a sheet between respective sheet conveying devices of an upstream apparatus and a downstream apparatus, and a control method therefor as well as a control program for implementing the method and a storage medium storing the program.

To attain the above object, in a first aspect of the present invention, there is provided a sheet conveying system comprising a first sheet conveying device having a first sheet conveying unit that conveys a sheet, and a second sheet conveying device having second sheet conveying that conveys the sheet and passing the sheet to the first sheet conveying unit, wherein the second sheet conveying device comprises: an abnormality detecting unit that detects occurrence of an abnormality in the conveyance of the sheet in the second sheet conveying unit; a passing completion-detecting unit that detects completion of passes of the sheet to the first sheet conveying device; and a notification unit that notifies the first sheet conveying device of a result of the detection by the abnormality detecting means and a result of the detection by the passing completion-detecting means, and wherein the first sheet conveying device comprises: a receiving unit that receives contents of the notification from the notification unit; and a suspension unit that suspends the conveyance of the sheet by the first sheet conveying unit when the receiving unit has received the contents of the notification.

With the configuration of the first aspect of the present invention, in the sheet conveying system including the second sheet conveying device for passing a sheet to the first sheet conveying device, when the first sheet conveying device has received contents of a notification of a result of detection of occurrence oft abnormality in the conveyance of a sheet in the second sheet conveying device and a result of detection of completion of passing of the sheet to the first sheet conveying device, the first sheet conveying device suspends the conveyance of the sheet. Therefore, when jamming has occurred during passing of a sheet between the respective sheet conveying devices of an upstream apparatus and a downstream apparatus, it is possible to prevent a jammed sheet from being mixed with processed sheets, reduce waste in sheets and toners, and further alleviate user's operations.

Preferably, the suspension unit suspends the conveyance of the sheet by stopping the conveyance of the sheet.

Preferably, the suspension unit suspends the conveyance of the sheet by discharging the sheet onto an escape tray.

To attain the above object, in a second aspect of the present invention, there is provided a method of controlling a sheet conveying system comprising a first sheet conveying device having a first sheet conveying unit that conveys a sheet, and a second sheet conveying device having a second sheet conveying unit that conveys the sheet and passes the sheet to the first sheet conveying unit, wherein the second sheet conveying device performs: an abnormality-detecting step of detecting occurrence of an abnormality in the conveyance of the sheet in the second sheet conveying means; a passing completion-detecting step of detecting completion of passing of the sheet to the first sheet conveying device; and a notification step of notifying the first sheet conveying device of a result of the detection in the abnormality-detecting step and a result of the detection in the passing completion-detecting step, and wherein the first sheet conveying device performs: a receiving step of receiving contents of the notification in the notification step; and a suspension step of suspending the conveyance of the sheet by the first sheet conveying unit when the contents of the notification have been received in the receiving step.

Preferably, the suspension step suspends the conveyance of the sheet by stopping the conveyance of the sheet.

Preferably, the suspension step suspends the conveyance of the sheet by discharging the sheet onto an escape tray.

To attain the above object, in a third aspect of the present invention, there is provided a computer-executable control program for causing a computer to execute a method of controlling a sheet conveying system comprising a first sheet conveying device having a first sheet conveying unit that conveys a sheet, and a second sheet conveying device having a second sheet conveying unit that conveys the sheet and passes the sheet to the first sheet conveying unit, comprising: a program part for the second sheet conveying device, the program part comprising an abnormality-detecting module for detecting occurrence of an abnormality in the conveyance of the sheet in the second sheet conveying means, a passing completion-detecting module for detecting completion of passing of the sheet to the first sheet conveying device, and a notification module for notifying the first sheet conveying device of a result of the detection by the abnormality-detecting module and a result of the detection by the passing completion-detecting module; and a program part executed for the first sheet conveying device, the program part comprising: a receiving module for receiving contents of the notification by the notification module; and a suspension module for suspending the conveyance of the sheet by the first sheet conveying means when the receiving module has received the contents of the notification.

To attain the above object, in a fourth aspect of the present invention, there is provided a computer readable storage medium storing the control program.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the present invention and, together with the description, serve to explain the principles of the present invention.

DETAILED DESCRIPTION OF THE PREFERRED EMBODIMENTS

Preferred embodiments of the present invention will be described in detail below with reference to the drawings.

Figure 1:
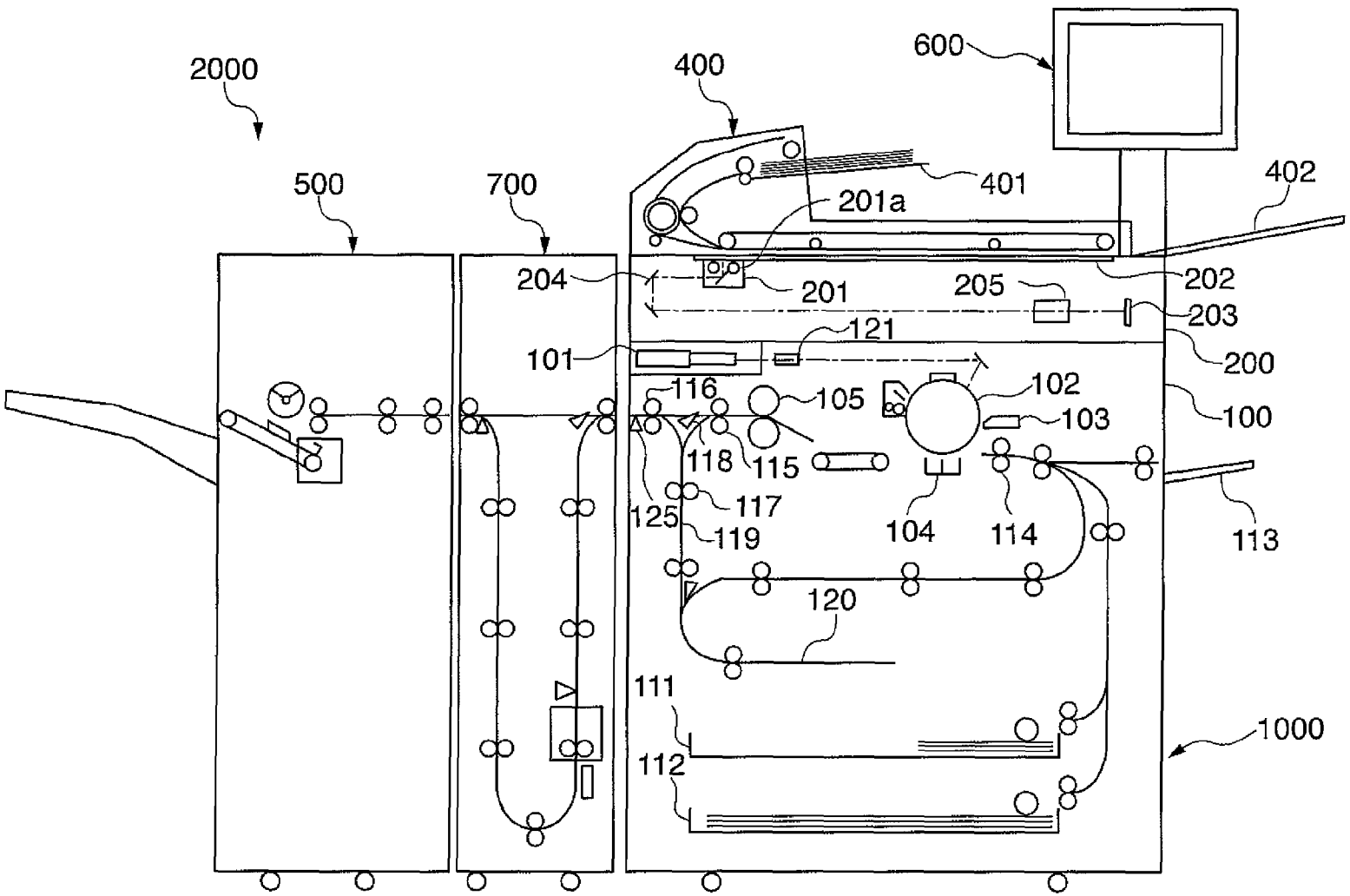
FIG. 1 is a schematic cross-sectional view of the internal construction of a sheet conveying system according to an embodiment of the present invention.

FIG. 1 is a schematic cross-sectional view of the internal construction of a sheet conveying system according to an embodiment of the present invention.

As shown in FIG. 1, an image forming system 2000 as the sheet conveying system according to the embodiment of the present invention is comprised of an image forming apparatus 1000, a puncher 700, and a staple stacker 500. The image forming apparatus 1000 is comprised of an original feeder section 400, an image reader section 200, a printer section 100, and an operating display section 600.

The original feeder section 400 includes a tray 401 on which originals are stacked. The originals stacked on the tray 401 are sequentially conveyed leftward, as viewed in FIG. 1, by the original feeder section 400 one by one from a first page such that the binding position of each original is at a leading end thereof. It should be noted that the originals are stacked on the tray 401 in a positionally correct state in which image-formed surfaces thereof face upward (hereinafter referred to as "in the face-up state") and such that the binding position of the originals is at the left end thereof (in the case of left-bound originals).

The original feeder section 400 further includes a discharge tray 402 onto which the conveyed originals are each discharged after passing through a curved path and then being conveyed rightward, as viewed in FIG. 1, over a platen glass 202, referred to hereinafter.

The image reader section 200 includes the platen glass 202 on which an original is disposed, and a scanner section 201 provided below the platen glass 202.

Further, the image reader section 200 includes a lamp 201*a* provided in the scanner section 201, for irradiating light onto each conveyed original, a mirror 204 for guiding reflected light from the original irradiated with light, a lens 205 for receiving the reflected light guided by the mirror 204, and an image sensor 203 for photoelectrically converting the reflected light received via the lens 205 and outputting an analog image signal as image data of the original.

A method of reading image data from an original using the scanner section 201 includes a moving original-reading method in which the scanner section 201 is held at a predetermined location, and an original is conveyed rightward on the platen glass 202, as viewed in FIG. 1, whereby an image of the original is read, and a fixed original-reading method in which an original is held on the platen glass 202, and the scanner section 201 is moved rightward, as viewed in FIG. 1, whereby an image of the original is read.

When the fixed original-reading method is employed, the original feeder section 400 may convey each original onto the platen glass 202, or the user may set the same on the platen glass 202 by lifting the original feeder section 400, instead of putting the original feeder section 400 to use.

The printer section 100 includes an exposure control section 101 that receives the analog image signal output from the image sensor 203 as a video signal subjected to predetermined processing by an image signal control section 281, referred to hereinafter, and outputs the video signal as a laser beam after subjecting the same to predetermined image processing, a rotating polygon mirror 121 that reflects the output laser beam, a photosensitive drum 102 on which an electrostatic latent image is formed by scanning of the reflected laser beam, and a developing device 103 that develops and visualizes the electrostatic latent image formed on the photosensitive drum 102 into a toner image.

Further, the printer section 100 includes cassettes 111 and 112 having sheets on which sheets are stacked, a manual sheet feeder section 113, a double-sided conveying path 120, registration rollers 114 with which the leading end of each sheet fed from the cassette 111 or 112 is brought into abutment at a location forward of a transfer section 104, described hereinafter, for temporary stoppage and correction of inclination of the sheet, and from which the sheet is conveyed in timing synchronous with the start of irradiation of the laser beam, the transfer section 104 that transfers the above-mentioned visualized toner image to the conveyed sheet, and a fixing section 105 that performs fixing processing on the toner image transferred to the sheet having been conveyed thereto.

Furthermore, the printer section 100 includes a flapper 118 disposed at a location where a path for guiding the sheet having the toner image fixed and formed thereon branches toward the puncher 700 and the double-sided conveying path 120, for switching the sheet-conveying path between the two branches, discharge rollers 116 that convey the sheet conveyed via the flapper 118 toward the puncher 700, a conveyance sensor 125, referred to hereinafter, and a path 119 via which the sheet conveyed via the flapper 118 is conveyed to the double-sided conveying path 120.

When the trailing end of the sheet conveyed to the path 119 by switching of the flapper 118 passes through the flapper 118, the sheet is inverted in the direction of conveyance thereof (switched back). Then, the sheet is conveyed to the discharge rollers 116 by switching of the flapper 118, and discharged from the printer section 100 by the discharge rollers 116 to be conveyed to the puncher 700. This enables the printer section 100 to convey the sheet formed with the toner image to the puncher 700 in a state in which a toner image-formed surface thereof faces downward (hereinafter referred to as "in the face-down state").

As described above, when an image forming process is carried out on sheets sequentially from a first page by discharging each sheet from the printer section 100 in the face-down state, e.g. when the image forming process is carried out based on image data of originals read by the original feeder section 400, or when the same is carried out based on image data input from a computer, it is possible to properly arrange image-formed sheets in order of page number.

The operating display section 600 is configured such that the user can set a post processing mode, etc.

The puncher 700 conveys sheets discharged from the printer section 100 by the discharge rollers 116 and carries out a process for punching the sheets (hereinafter referred to as "the punching process").

The puncher 700 performs the punching process on the sheets discharged from the printer section 100 when the image forming apparatus 1000 is configured via the operating display section 600 thereof to carry out the punching process, whereas when not configured to carry out the punching process, the puncher 700 conveys each sheet directly to the staple stacker 500 without performing the punching process thereon.

The staple stacker 500 performs post processing on the sheets conveyed from the printer section 100 thereto via the puncher 700.

Figure 2:
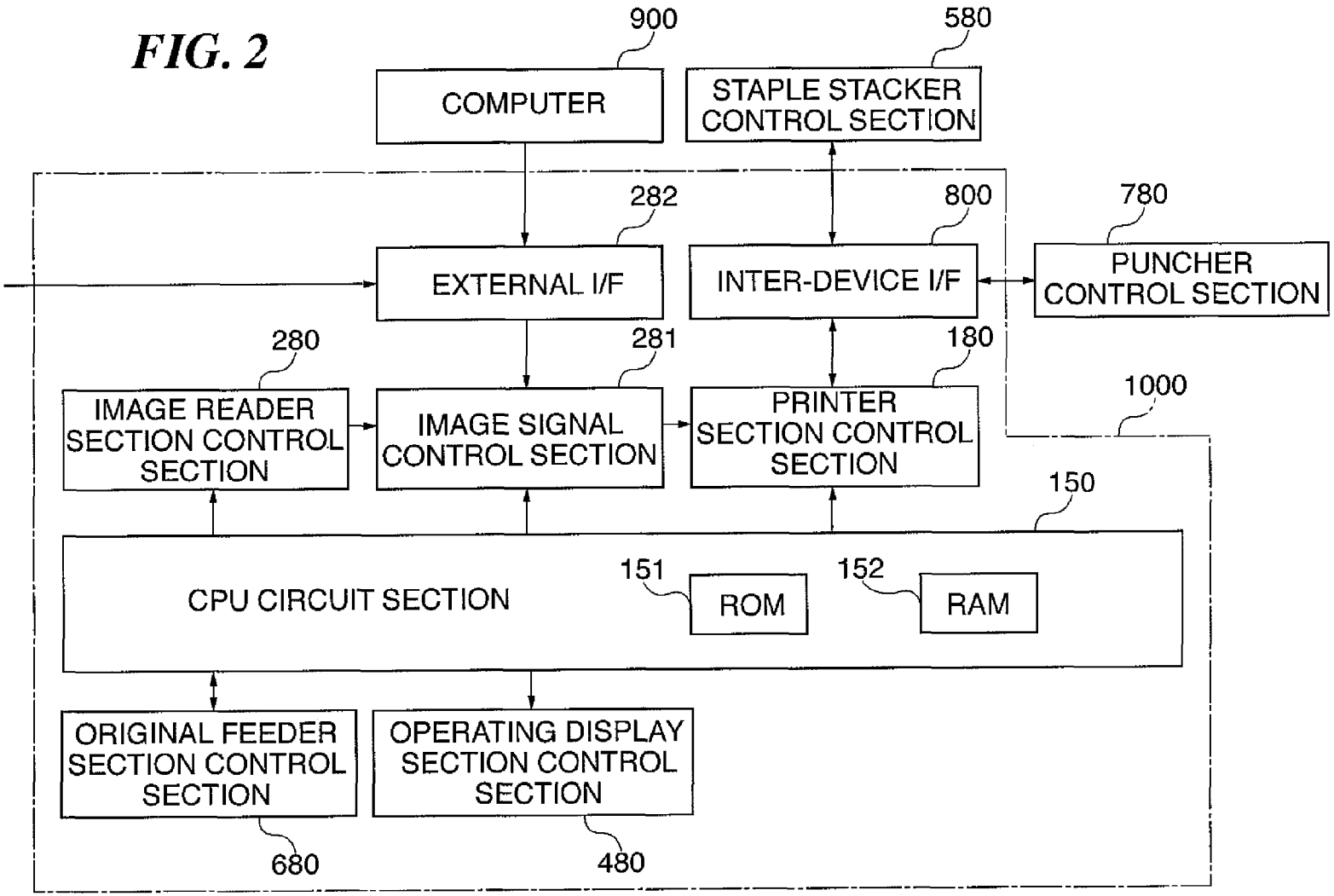
FIG. 2 is a schematic block diagram of an image forming apparatus appearing in FIG. 1.

FIG. 2 is a schematic block diagram of the image forming apparatus 1000 appearing in FIG. 1.

As shown in FIG. 2, the image forming apparatus 1000 includes an original feeder section control section 480, an image reader section control section 280, a CPU circuit section 150 that delivers signals to these section 480 and 280, and an operating display section control section 680 that transmits and receives signals to and from the CPU circuit section 150.

The image forming apparatus 1000 also includes an external I/F 282 that receives signals from an external computer 900, and the image signal control section 281 that receives signals from the image reader section control section 280, the CPU circuit section 150, and the external I/F 282.

Further, the image forming apparatus 1000 includes an inter-device I/F 800 that transmits and receives signals to and from an external staple stacker control section 580 and an external puncher control section 780, and a printer section control section 180 that receives signals from the image signal control section 281 and the CPU circuit section 150, and transmits and receives signals to and from the inter-device I/F 800.

The CPU circuit section 150 includes a CPU (not shown), a ROM 151 that stores control programs, and a RAM 152 that is used as an area for temporarily holding control data and a work area for performing computation involved in control operations. The CPU circuit section 150 controls the original feeder section control section 480, the operating display section control section 680, the image reader section control section 280, the image signal control section 281, and the printer section control section 180 based on the stored control programs and a signal transmitted from the operating display section 600 in FIG. 1.

Further, the CPU circuit section 150 carries out a sheet passing process described hereinafter with reference to FIG. 5 or FIG. 10.

The original feeder section control section 480 drivingly controls the original feeder section 40. Similarly, the image reader section control section 280, the printer section control section 180, the operating display section control section 680, the puncher control section 780, and the staple stacker control section 580 drivingly control the image reader section 200, the printer section 100, the operating display section 600, the puncher 700, and the staple stacker 500, respectively.

The image reader section control section 280 drivingly controls the scanner section 201, the image sensor 203, etc., and transfers the analog image signal output from the image sensor 203 to the image signal control section 281.

The image signal control section 281 converts the analog image signal input by the image sensor 203 to a digital image signal, then performs predetermined processing on the digital image signal, converts the digital image signal to a video signal, and delivers the video signal to the printer section control section 180. Further, the image signal control section 281 performs predetermined processing on the digital image signal input from the computer 900 via the external I/F 282, converts the digital image signal to a video signal, and delivers the video signal to the printer section control section 180.

The printer section control section 180 drives the above-described exposure control section 101 based on the video signal input by the image signal control section 281.

The operating display section control section 680 sends and receives information to and from the operating display section 600 and the CPU circuit section 150. The operating display section 600 has a plurality of keys for setting various functions concerning image formation, a display section for displaying information indicative of settings of the functions of the keys, and so forth. The operating display section 600 delivers key signals associated with respective key operations to the CPU circuit section 150, and displays corresponding information based on signals from the CPU circuit section 150.

The puncher control section 780 and the staple stacker control section 580 send and receive signals concerning sheet information and the conveying of sheets, to and from each other, to thereby carry out post processing control of sheets having images formed thereon.

Hereinafter, a description will be given of a flow of sheets having images formed thereon when they are discharged onto a stack tray with reference to FIGS. 3 and 4.

Figure 3:
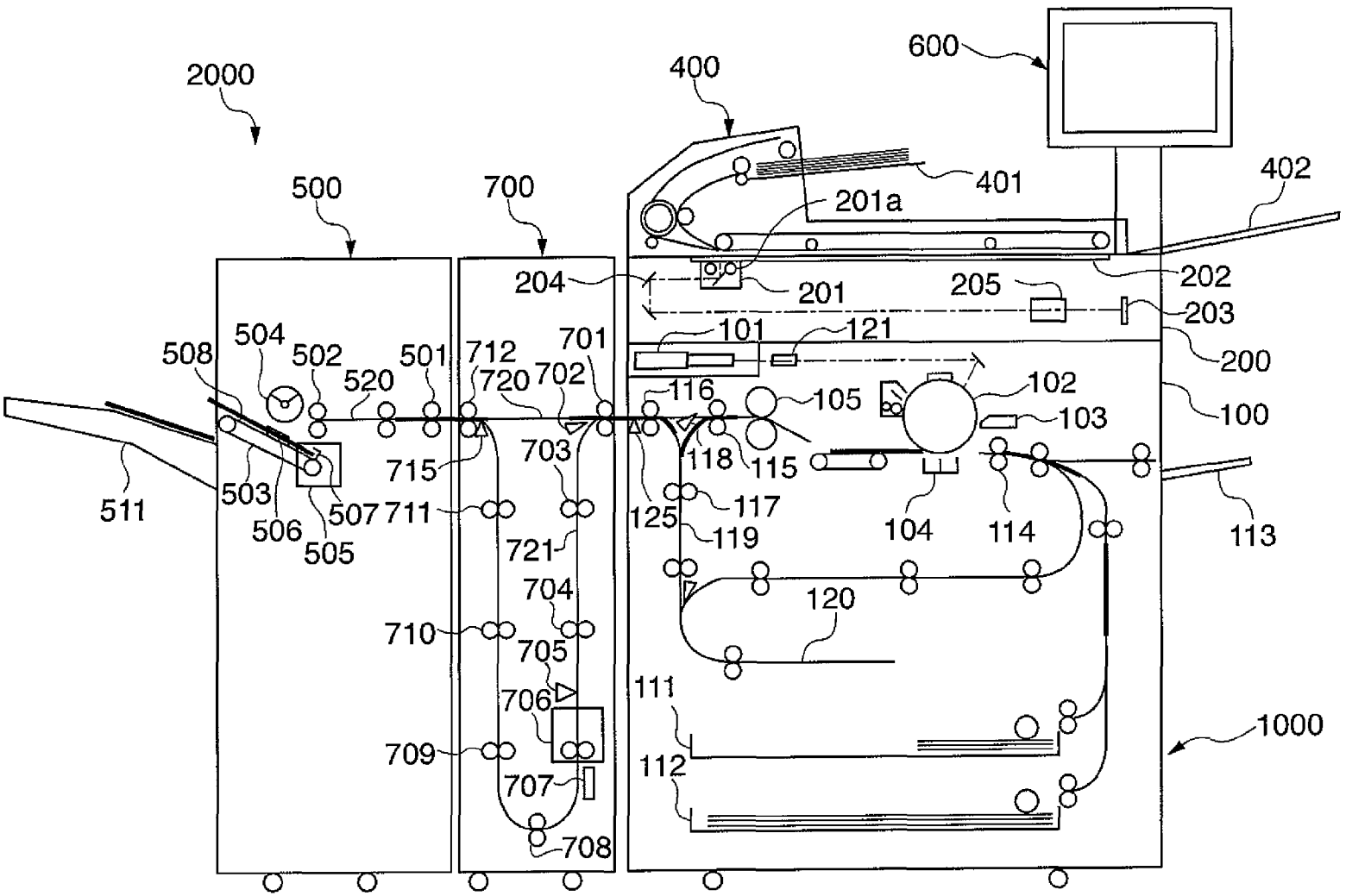
FIG. 3 is a cross-sectional view of an image forming system appearing in FIG. 1, which shows a case in which a punching process is not set to a post processing mode.
Figure 4:
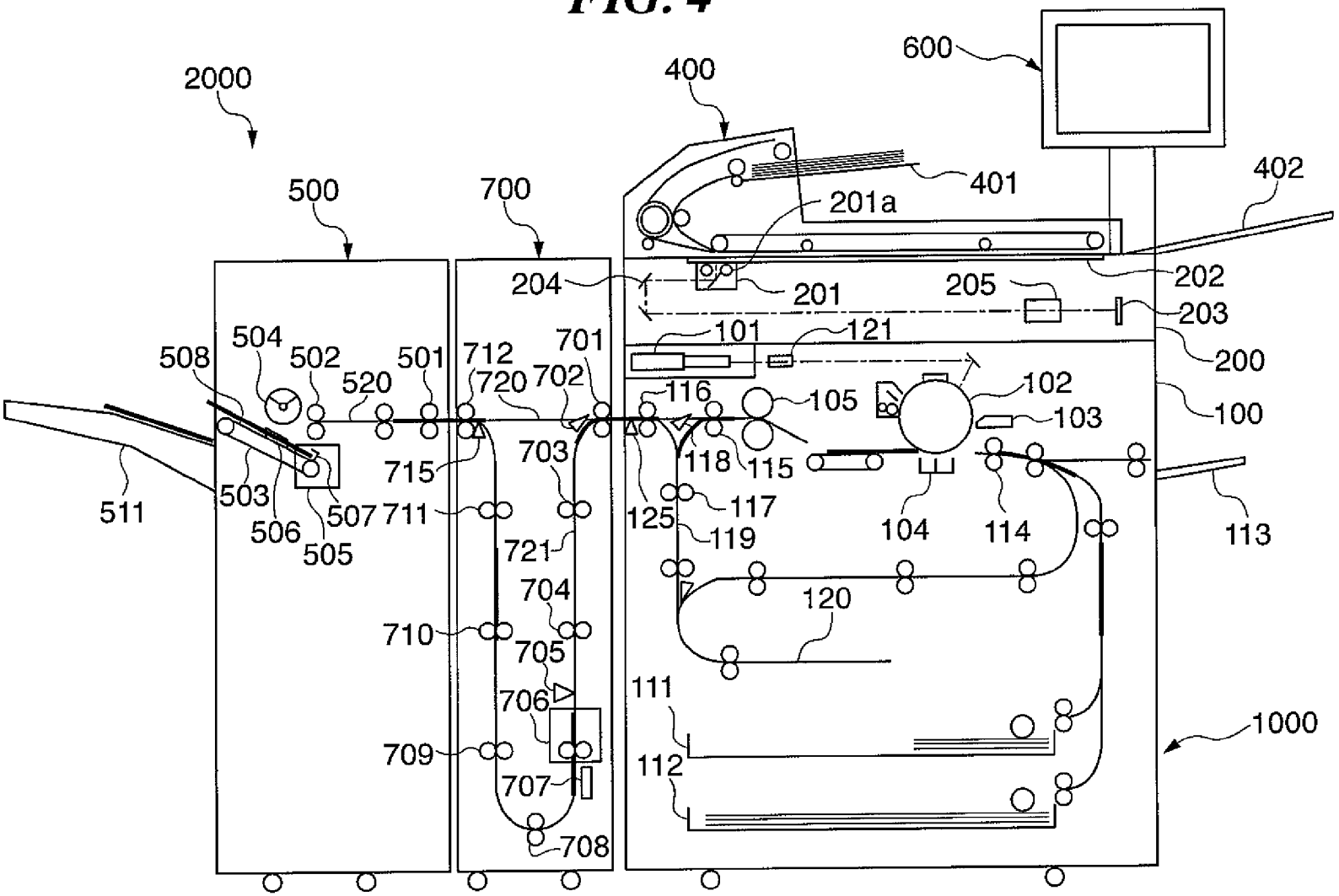
FIG. 4 is a cross-sectional view of the image forming system in FIG. 1, which shows a case in which the punching process is set to the post processing mode.

FIGS. 3 and 4 are cross-sectional views of the image forming system 2000 in FIG. 1, respectively. FIG. 3 shows a case in which the punching process is not set to the post processing mode, whereas FIG. 4 shows a case in which the punching process is set to the post processing mode.

Referring to FIG. 3, a sheet having an image formed thereon by the image forming apparatus 1000 is conveyed from the printer section 100 of the image forming apparatus 1000 to the puncher 700 in the face-down state. In this case, since the punching process is not set to the post processing mode, the sheet conveyed to the puncher 700 is conveyed to a conveying path 720 by conveying rollers 701 and a flapper 702, arranged at an entrance of the puncher 700, and then discharged from the puncher 700 by discharge rollers 712 arranged at an exit of the puncher 700 to be conveyed to the staple stacker 500. As described above, when the punching process is not set to the post processing mode, the puncher 700 performs only conveyance of sheets.

Referring to FIG. 4, a sheet having an image formed thereon by the image forming apparatus 1000 is conveyed from the printer section 100 of the image forming apparatus 1000 to the puncher 700 in the face-down state. In this case, since the punching process is set to the post processing mode, the sheet conveyed to the puncher 700 is conveyed to a punching path 721 by the conveying rollers 701 and the flapper 702, arranged at the entrance of the puncher 700. The sheet conveyed to the punching path 721 is conveyed by conveying rollers 703 and 704 arranged on the punching path 721, and the leading end of the sheet is detected by a sensor 705. The conveying of the sheet is stopped by a punching section 706 after the lapse of a predetermined time period based on the result of the detection, and the sheet is abutted against an abutment plate 707 disposed orthogonally to the punching path 721 by being pivotally moved through 90 degrees in the normal direction, whereby the sheet is subjected to the punching process. After termination of the punching process, the abutment plate 707 is pivotally moved through 90 degrees in the reverse direction, and the conveyance of the sheet by the punching section 706 is resumed, whereby the sheet is conveyed by conveying rollers 708 to 711 and is discharged from the puncher 700 by the discharge rollers 712, to be conveyed to the staple stacker 500.

Referring to FIG. 3 or 4, the sheet conveyed to the staple stacker 500 is conveyed to a conveying path 520 by conveying rollers 501, and is discharged onto a sheet bundle discharge belt 503 by discharge rollers 502. The sheet bundle discharge belt 503 is provided with a low-friction intermediate processing tray 508 which is disposed in parallel with the sheet bundle discharge belt 503 at a location higher than the sheet bundle discharge belt 503 by several millimeters, and therefore, accurately speaking, the sheet is discharged onto the intermediate processing tray 508. Since the intermediate processing tray 508 is slantingly disposed, the discharged sheet falls rightward and downward by its own weight along the intermediate processing tray 508. Further, a sectoral return roller 504 rotates counterclockwise, whereby a friction member (not shown) provided along a circular arc of the return roller 504 is brought into contact with the sheet, whereby the sheet is caused to fall rightward and downward by the friction member as well, so that the right end of the sheet is abutted against a stopper plate 507 provided rightward and downward of the intermediate processing tray 508. Thus, an alignment operation is performed for aligning sheets in the direction of the length (feed) thereof.

Further, the sheets on the intermediate processing tray 508 are laterally aligned (in the direction of the width thereof) by registration plates 506 which are provided on the front side and the rear side of the intermediate processing tray 508 and are driven whenever each sheet is discharged onto the intermediate processing tray 508.

When a predetermined number of discharged sheets are stacked on the intermediate processing tray 508, the sheet bundle discharge belt 503 is driven, whereby the stacked sheet bundle is discharged onto the stack tray 511. Further, if a staple mode has been set to the post processing mode by the operating display section 600, a bundle of sheets to be subjected to staple processing are discharged onto the intermediate processing tray 508, and the alignment operation is performed by the registration plates 506 for aligning the sheets. After that, the staple processing is performed by driving a stapler 505, and a sheet bundle having been subjected to the staple processing is discharged onto the stack tray 511 by the sheet bundle discharge belt 503.

The stapler 505 is configured to be movable laterally with respect to the sheets on the intermediate processing tray 508 such that the stapler 505 can perform the staple processing on the sheets at desired positions on the front side and the rear side thereof. The positions on the sheets where the stapler 505 should perform the staple processing are set from the operating display section 600.

In detecting jamming during conveyance of a sheet in the image forming system 2000 as illustrated in FIGS. 3 and 4, there is employed a method of detecting jamming based on a sheet-conveying time period taken to convey a sheet between sensors, such as the conveyance sensor 125, mounted on the conveying path. The sheet-conveying time period is determined based on the rotational speed of a motor (not shown) for conveying a sheet and the length of the sheet.

After a sheet being conveyed has passed one of the sensors, if the presence of the sheet cannot be detected by the next sensor even after the elapse of a sheet-conveying time period to be taken for the sheet to reach the next sensor, it is detected that jamming has occurred between the last sensor that detected the presence of the sheet and a sensor following the last sensor.

Further, after a sensor has detected the presence of a sheet, if the sensor cannot detect the absence of the sheet even after the elapse of a time period to be taken for the sheet to pass the sensor, it is detected that jamming has occurred at a location corresponding to the sensor that could not detect the absence of the sheet.

In the present embodiment, when jamming is detected, a location where the jamming has occurred is detected by the above-described detecting method, and the user is prompted to remove the jammed sheet. Then, after completion of the jammed sheet by the user, the image forming process is resumed from a sheet corresponding to the jammed sheet.

Hereinafter, a description will be given of the sheet passing process for passing a sheet between the image forming apparatus 1000 and the puncher 700 or between the puncher 700 and the staple stacker 500, in the image forming system 2000.

Figure 5:
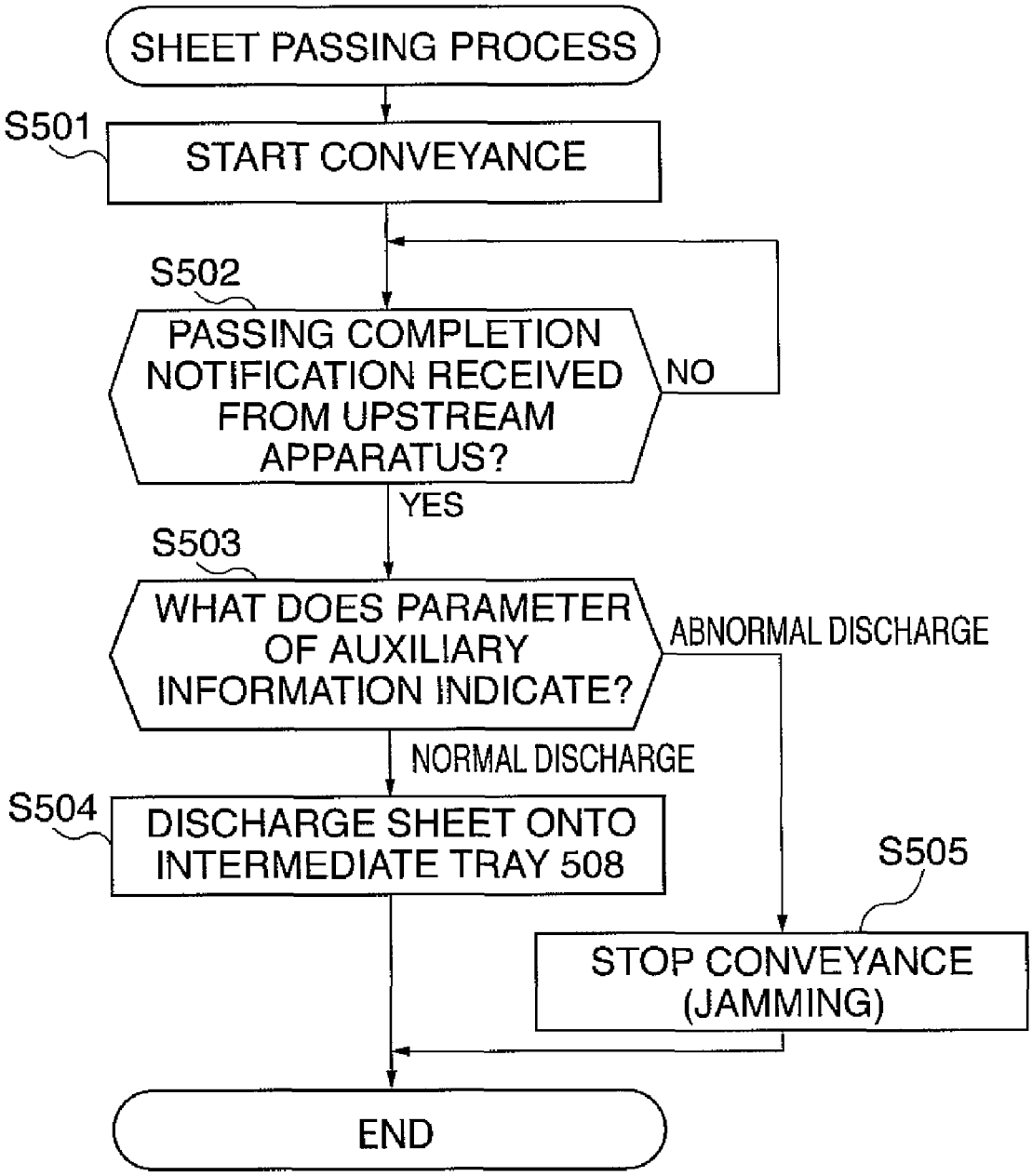
FIG. 5 is a flowchart of a sheet passing process executed by a CPU circuit section appearing in FIG. 2.

FIG. 5 is a flowchart showing the sheet passing process executed by the CPU circuit section 150 appearing in FIG. 2.

Although in the present embodiment, a description is given of the sheet passing process between the puncher 700 and the staple stacker 500, a similar process is carried out between the image forming apparatus 1000 and the puncher 700.

Referring to FIG. 5, first, when the passing of a sheet S1 from the puncher 700 as an upstream apparatus to the staple stacker 500 as a downstream apparatus is started, the conveyance of the sheet S1 is started e.g. by the conveying rollers 501 and the like of the staple stacker 500 (step S501), and when discharge of the trailing end of the sheet S1 from the puncher 700 is completed, the puncher control section 780 issues a notification of completion of the passing (passing completion notification), referred to hereinafter, to the staple stacker control section 580 via the inter-device I/F 800. Upon reception of the passing completion notification (YES to S502), the staple stacker control section 580 determines whether a parameter of auxiliary information of the notification indicates a normal discharge or an abnormal discharge (step S503).

If it is determined in the step S503 that the parameter of the auxiliary information of the notification indicates a normal discharge, the staple stacker 500 discharges the sheet S1 to the intermediate processing tray 508 (step S504), followed by terminating the present process.

Figure 8:
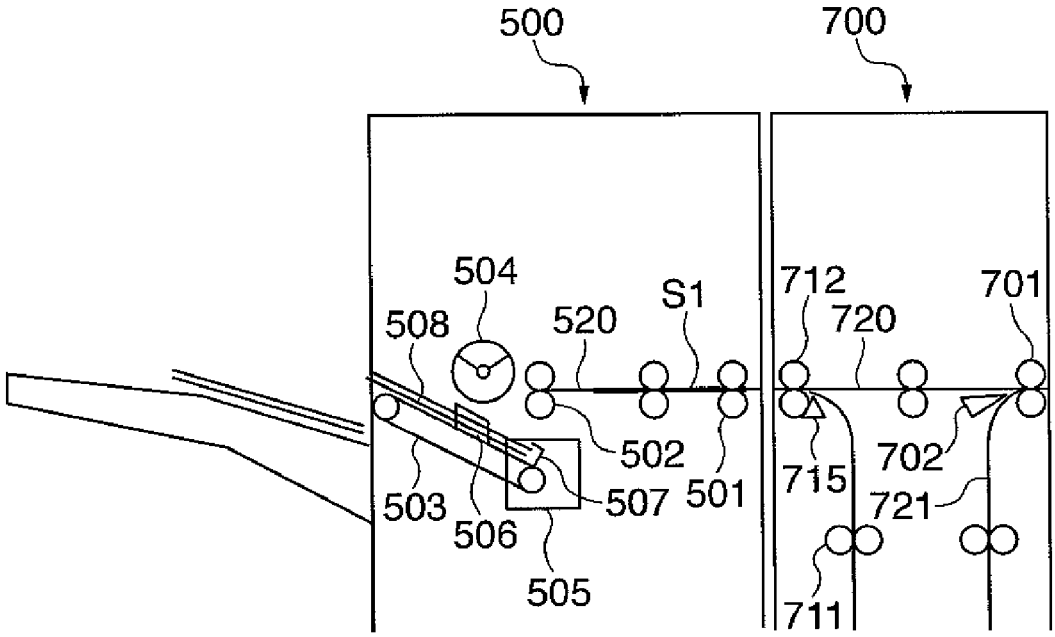
FIG. 8 is a fragmentary cross-sectional view of the part of the internal construction of the image forming system in FIG. 1, which shows a case in which the staple stacker has stopped conveying the jammed sheet.

If it is determined in the step S503 that the parameter of the auxiliary information of the passing completion notification indicates an abnormal discharge, the staple stacker 500 stops the conveyance of the sheet S1 (FIG. 8), and notifies the printer section control section 180 of occurrence of jamming. When notified of the occurrence of jamming, the printer section control section 180 notifies the CPU circuit section 150 of the jamming. The CPU circuit section 150 displays the occurrence of the jamming and a location where the jamming has occurred, to thereby prompt the user to remove the jammed sheet. After completion of removal of the jammed sheet by the user, the image forming process is resumed from a sheet corresponding to the jammed sheet (step S505), followed by terminating the present process.

The parameter of the auxiliary information of the passing completion notification is assumed to indicate "a normal discharge" when the trailing end of the sheet S1 is normally discharged from the puncher 700.

Figure 6:
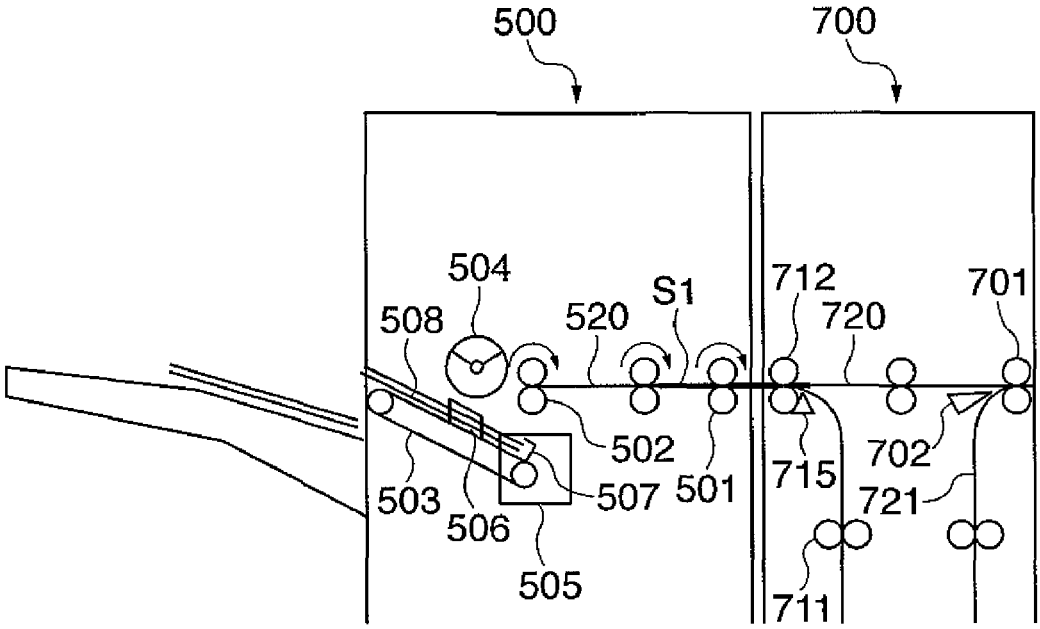
FIG. 6 is a fragmentary cross-sectional view of part of the internal construction of the image forming system in FIG. 1, which shows a case in which jamming has occurred in a puncher.
Figure 7:
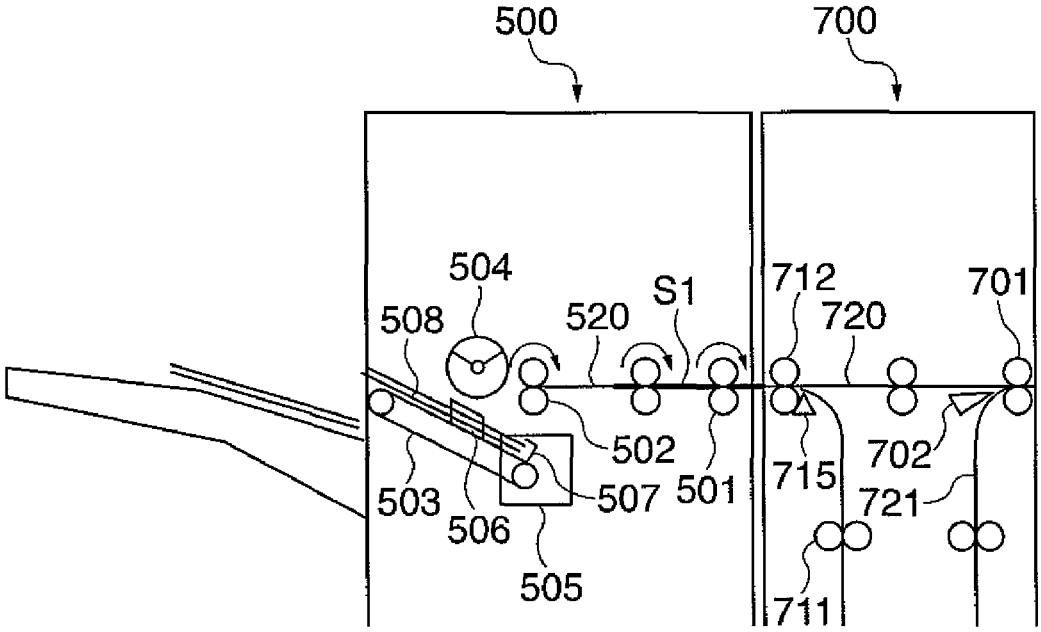
FIG. 7 is a fragmentary cross-sectional view of the part of the internal construction of the image forming system in FIG. 1, which shows a case in which a staple stacker has drawn out a jammed sheet.

Further, when a sensor 715 provided in association with the discharge rollers 712 detects jamming after the start of passing of the sheet S1 from the puncher 700 to the staple stacker 500, the puncher 700 stops the passing of the sheet S1, but the staple stacker 500 does not recognize the jamming in the puncher 700. Therefore, the staple stacker 500 does not stop the conveyance of the sheet S1 (FIG. 6), and further the leading end of the sheet S1 has been nipped by the conveying rollers 501 of the staple stacker 500, so that the sheet S1 is drawn out from the puncher 700 to be conveyed to the staple stacker 500 (FIG. 7). To stop such conveyance of the sheet S1, when it is detected that jamming has occurred in the puncher 700, but the sensor 715 detects the absence of the sheet S1, the puncher control section 780 sets the parameter of the auxiliary information of the passing completion notification such that it indicates "an abnormal discharge".

Although in the present embodiment, a detailed description has been given of the passing of a sheet between the puncher 700 and the staple stacker 500, by way of example, this is not limitative, but also in the case where the length of a sheet is larger than the width of the puncher 700, and during discharge of the sheet from the printer section 100, the leading end of the sheet has entered the staple stacker 500, if jamming occurs in the printer section 100, the conveyance of the sheet in the staple stacker 500 may be similarly stopped by the printer control section 180 issuing the passing completion notation with its auxiliary information set to indicate "an abnormal discharge" to the puncher control section 780 when the sheet is conveyed from the image forming apparatus 1000 to the puncher 700, and further by the puncher control section 780 issuing the passing completion notation with its auxiliary information set to indicate "an abnormal discharge" to the staple stacker control section 580 when the sheet is conveyed from the puncher 700 to the staple stacker 500.

According to the sheet passing process in FIG. 5, the staple stacker control section 580 of the staple stacker 500 as a downstream apparatus receives the passing completion notification of the sheet S1 from the puncher control section 780 of the puncher 700 as an upstream apparatus, and when the auxiliary information of the passing completion notification has a parameter indicative of an abnormal discharge (abnormal discharge in the step S503), the staple stacker control section 580 stops the conveyance of the sheet S1 (step S505). Therefore, when jamming has occurred during passing of the sheet S1 between the respective sheet conveying devices of the upstream and downstream apparatuses, it is possible to prevent a jammed sheet from being mixed with processed sheets.

Figure 9:
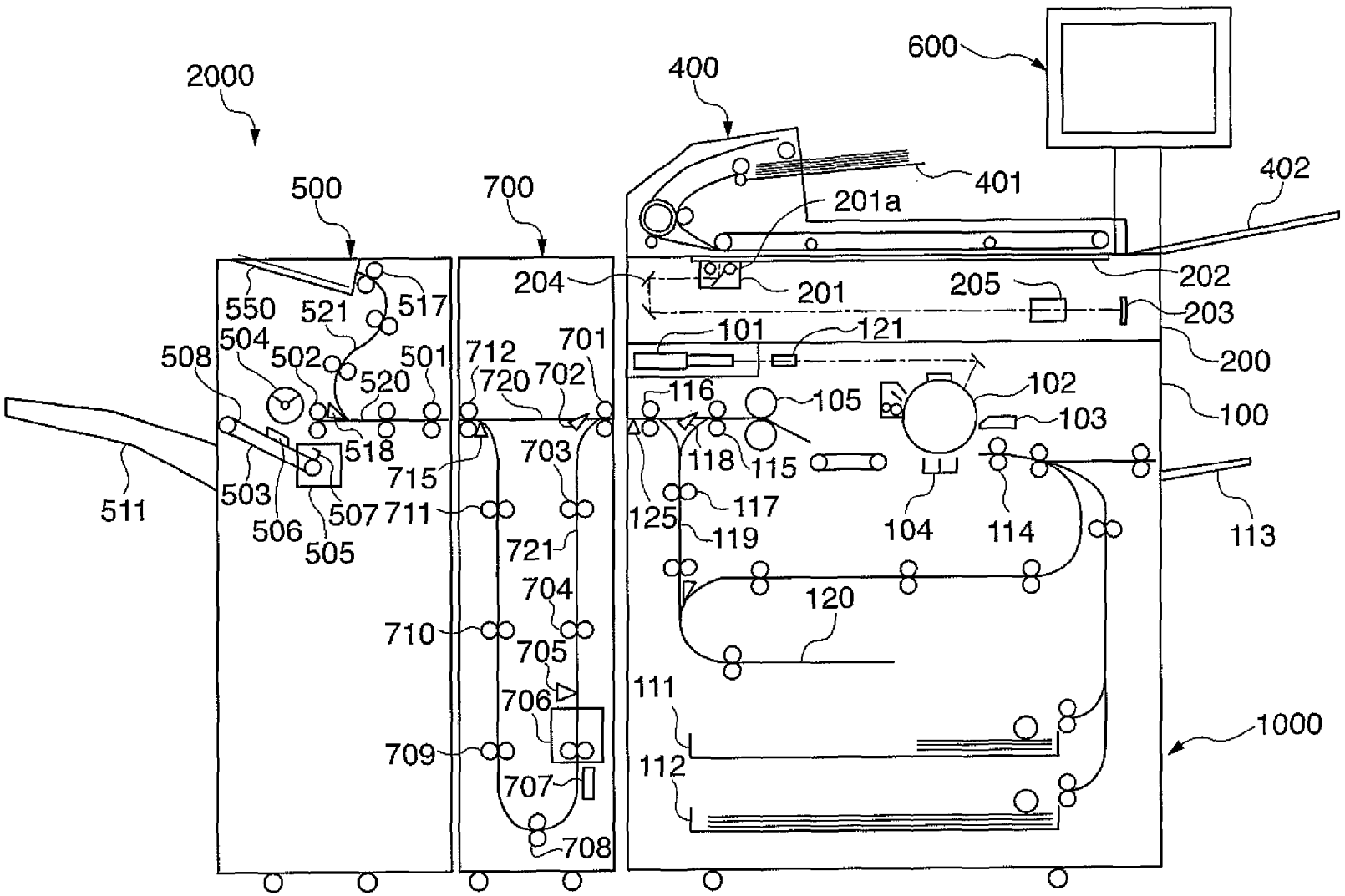
FIG. 9 is a schematic cross-sectional view of a variation of the internal construction of the sheet conveying system in FIG. 1.

FIG. 9 is a schematic cross-sectional view of a variation of the internal construction of the sheet conveying system in FIG. 1.

An image forming system 2000' shown in FIG. 9 is distinguished from the image forming system 2000 in FIG. 1 only in the construction of the staple stacker 500, but is basically the same in the other respects. Hereinafter, the construction of a staple stacker 500*a* of this variation and the operation thereof will be described.

Now, a description will be given of a sheet passing process for passing a sheet between the image forming apparatus 1000 and the puncher 700, or between the puncher 700 and the staple stacker 500*a*, in the image forming system 2000' in FIG. 9.

Figure 10:
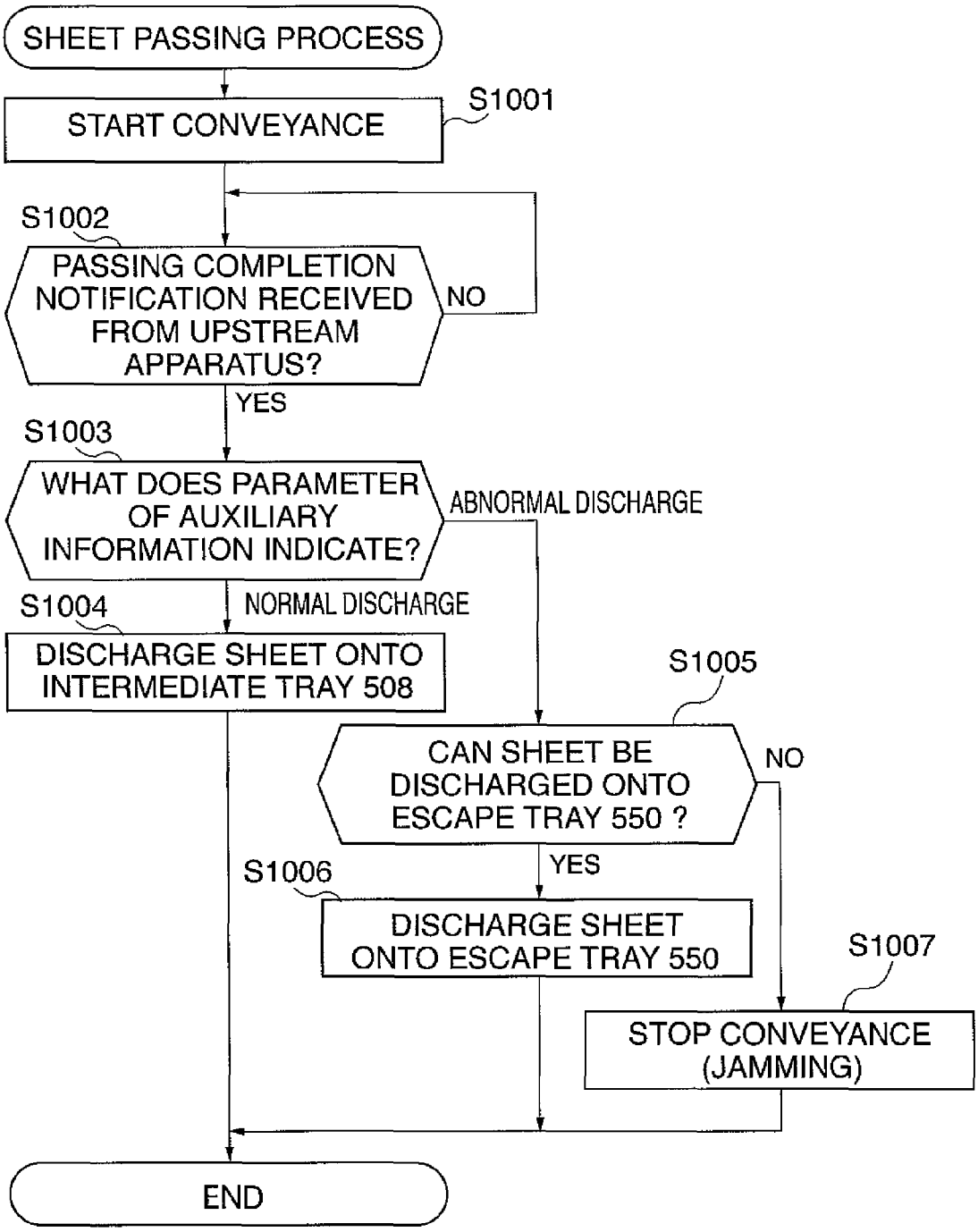
FIG. 10 is a flowchart showing a sheet passing process executed by the CPU circuit section appearing in FIG. 2.

FIG. 10 is a flowchart showing the sheet passing process executed by the CPU circuit section 150 in FIG. 2.

Although in the present embodiment, a description is given of the sheet passing process between the puncher 700 and the staple stacker 500*a*, a similar process is carried out between the image forming apparatus 1000 and the puncher 700.

Referring to FIG. 10, first, when the passing of a sheet S1 from the puncher 700 as an upstream apparatus to the staple stacker 500*a* as a downstream apparatus is started, the conveyance of the sheet S1 is started e.g. by the conveying rollers 501 of the staple stacker 500*a* (step S1001), and when discharge of the trailing end of the sheet S1 from the puncher 700 is completed, the puncher control section 780 issues a passing completion notification, referred to hereinafter, to the staple stacker control section 580 via the inter-device I/F 800. When receiving the passing completion notification (YES to S1002), the staple stacker control section 580 determines whether a parameter of auxiliary information of the notification indicates a normal discharge or an abnormal discharge (step S1003).

If it is determined in the step S1003 that the parameter of the auxiliary information of the notification indicates a normal discharge, the staple stacker 500*a* discharges the sheet S1 to the intermediate processing tray 508 (step S1004), followed by terminating the present process.

Figure 12:
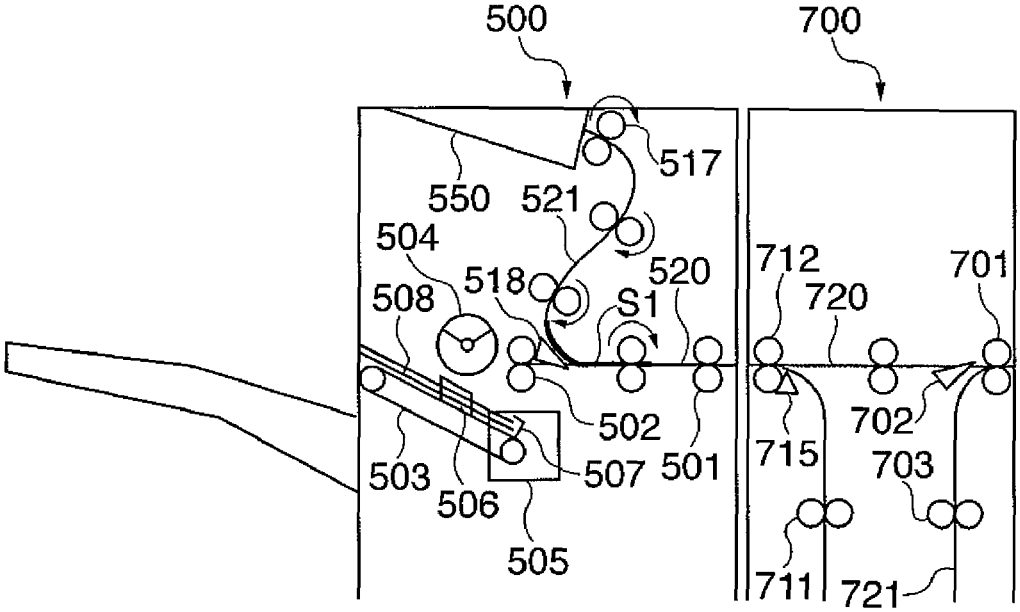
FIG. 12 is a fragmentary cross-sectional view of the part of the internal construction of the image forming system in FIG. 9, which shows a case in which a jammed sheet is conveyed to an escape tray.
Figure 13:
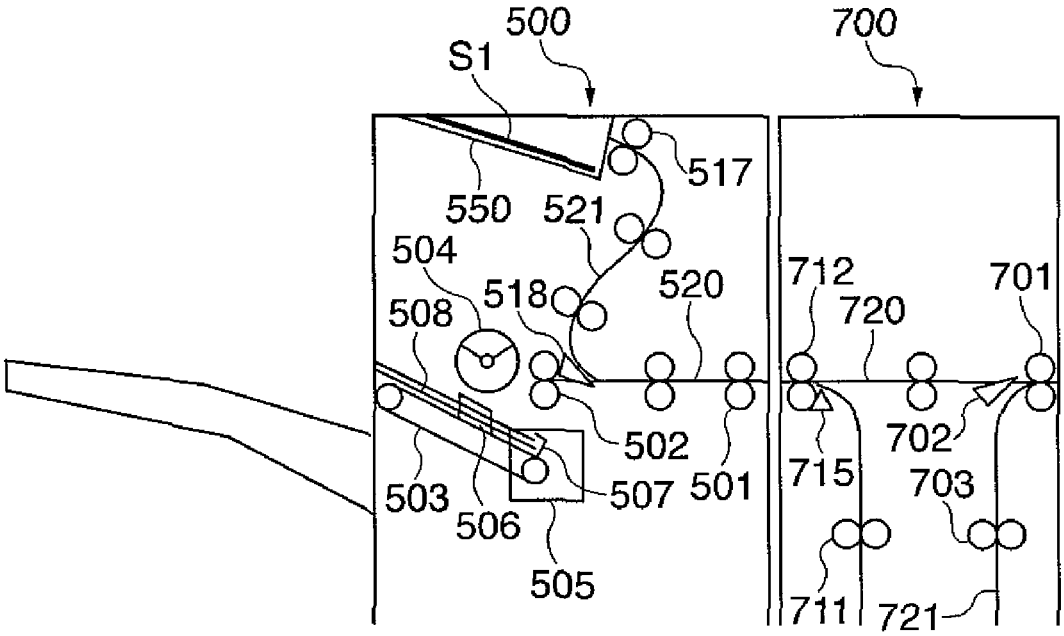
FIG. 13 is a fragmentary cross-sectional view of the part of the internal construction of the image forming system in FIG. 9, which shows a case in which the jammed sheet is discharged onto the escape tray.

If it is determined in the step S1003 that the parameter of the auxiliary information of the passing completion notification indicates an abnormal discharge, the staple stacker control section 580 determines whether or not the sheet S1 can be discharged onto an escape tray 550 disposed at a top of the staple stacker 500*a* (step S1005). If the sheet S1 can be discharged onto the escape tray 550, the staple stacker control section 580 switches a flapper 518 for conveyance of the sheet S1 (FIG. 12), to thereby discharge the sheet S1 onto the escape tray 550 (step S1006), followed by terminating the present process.

Figure 14:
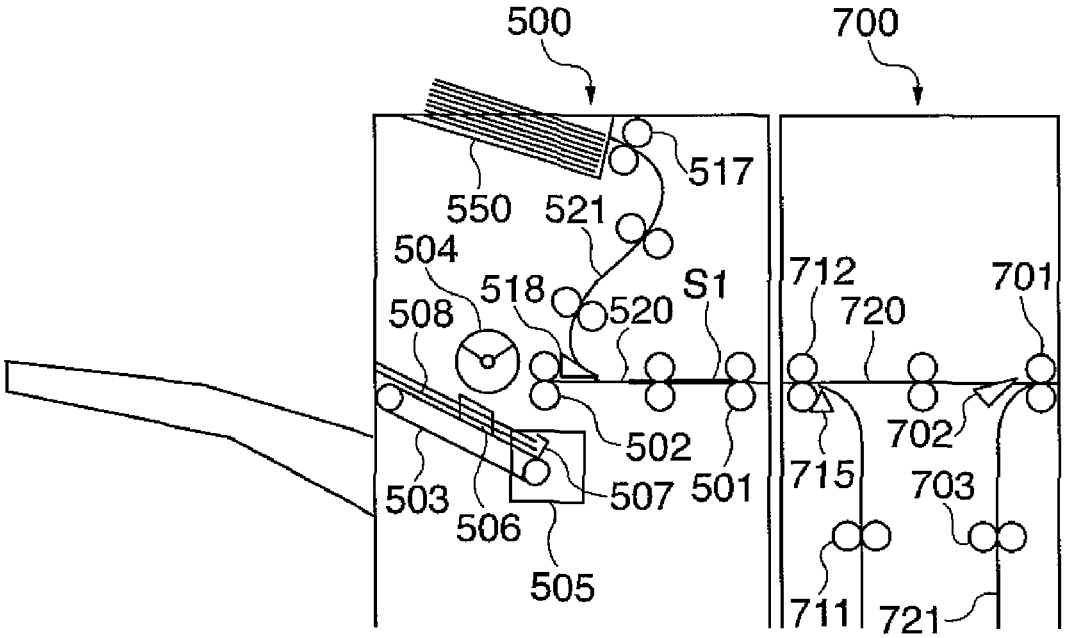
FIG. 14 is a fragmentary cross-sectional view of the part of the internal construction of the image forming system in FIG. 9, which shows a case in which the escape tray is in an excessively stacked condition.

If it is determined in the step S1005 that the sheet S1 cannot be discharged onto the escape tray 550 due to an excessively stacked condition or the like, the staple stacker control section 580 stops the conveyance of the sheet S1 (FIG. 14), and notifies the printer section control section 180 of occurrence of jamming. When notified of the occurrence of jamming, the printer section control section 180 notifies the CPU circuit section 150 of the jamming. The CPU circuit section 150 displays the occurrence of the jamming and a location where the jamming has occurred, to thereby prompt the user to remove the jammed sheet. After completion of removal of the jammed sheet by the user, the image forming process is resumed from a sheet corresponding to the jammed sheet (step S1007), followed by terminating the present process.

The parameter of the auxiliary information of the passing completion notification is assumed to indicate "a normal discharge" when the trailing end of the sheet S1 is normally discharged from the puncher 700.

Figure 11:
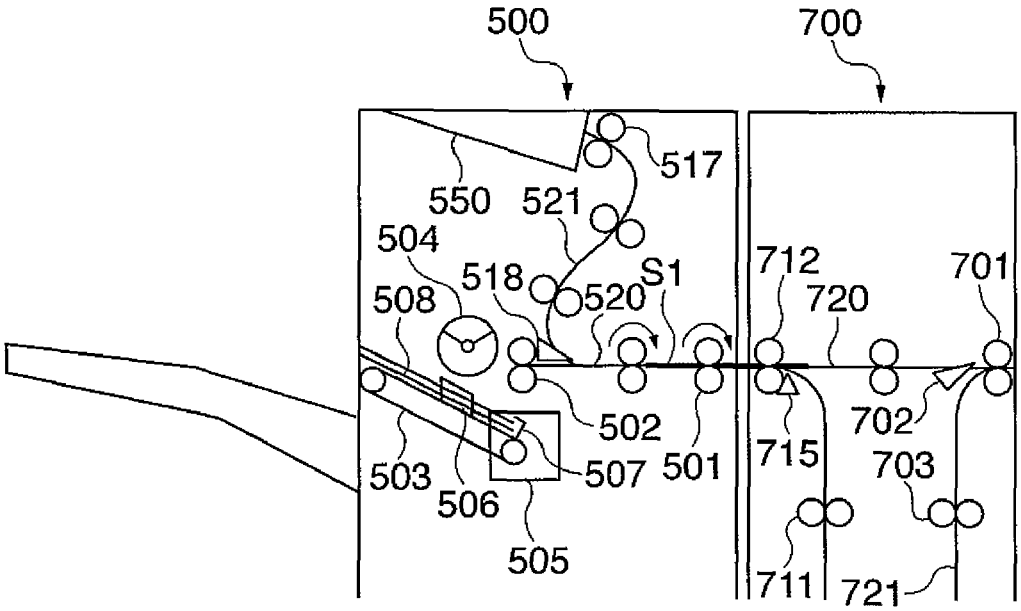
FIG. 11 is a fragmentary cross-sectional view of a part of the internal construction of an image forming system appearing in FIG. 9, which shows a case in which jamming has occurred in a puncher.

Further, when the sensor 715 detects jamming after the start of passing of the sheet S1 from the puncher 700 to the staple stacker 500*a*, the puncher 700 stops the passing of the sheet S1, but the staple stacker 500*a* does not recognize the jamming in the puncher 700. Therefore, the staple stacker 500*a* does not stop the passing of the sheet S1, and further, the leading end of the sheet S1 has been nipped by the conveying rollers 501 of the staple stacker 500*a*, so that the sheet S1 is drawn out from the puncher 700 to be conveyed to the staple stacker 500*a* (FIG. 11). To stop such conveyance of the sheet S1, when jamming has occurred in the puncher 700, and the sensor 715 has detected the absence of the sheet S1, the parameter of the auxiliary information of the passing completion notification is set to indicate "an abnormal discharge".

Although in the present embodiment, the escape tray is provided as a dedicated tray, if the staple stacker 500*a* has a plurality of trays, a tray that is not used during execution of a job may be used as an escape tray.

Although in the present embodiment, a detailed description has been given of the passing of a sheet between the puncher 700 and the staple stacker 500*a*, by way of example, this is not limitative, but also in the case where the length of a sheet is larger than the width of the puncher 700, and during discharge of the sheet from the printer section 100, the leading end of the sheet has entered the staple stacker 500*a*, if jamming occurs in the printer section 100, the conveyance of the sheet in the staple stacker 500*a* may be similarly stopped by the printer control section 180 issuing the passing completion notation with its auxiliary information set to indicate "an abnormal discharge" to the puncher control section 780 when the sheet is conveyed from the image forming apparatus 1000 to the puncher 700, and further by the puncher control section 780 issuing the passing completion notation with its auxiliary information set to indicate "an abnormal discharge" to the staple stacker control section 580 when the sheet is conveyed from the puncher 700 to the staple stacker 500*a*.

According to the sheet passing process in FIG. 10, the staple stacker control section 580 of the staple stacker 500*a* as a downstream apparatus receives a passing completion notification of the sheet S1 from the puncher control section 780 of the puncher 700 as an upstream apparatus, and when the auxiliary information of the passing completion notification has a parameter indicative of an abnormal discharge (abnormal discharge in the step S1003), if the sheet S1 can be discharged onto the escape tray 550 (YES to S1005), the staple stacker control section 580 causes the sheet S1 to be discharged onto the escape tray 550 (step S1006), whereas if the sheet S1 cannot be discharged onto the escape tray 550 (N0 to S1005), the staple stacker control section 580 stops conveyance of the sheet S1 (step S1007). Therefore when jamming has occurred during passing of the sheet S1 between the respective sheet conveying devices of the upstream and downstream apparatuses, it is possible to prevent a jammed sheet from being mixed with processed sheets.

In the present embodiment, it is possible to prevent a jammed sheet from being mixed with processed sheets, and hence it is possible to avoid the inconvenience that the image forming process is resumed from a first sheet of the sheet bundle by rejecting the entire bundle of processed sheets mixed with a jammed sheet. This makes it possible to reduce wasteful use of sheets and toners.

It is to be understood that the object of the present invention may also be accomplished by supplying a system or an apparatus with a storage medium in which a program code of software, which realizes the functions of the above-described embodiment is stored, and causing a computer (or CPU or MPU) of the system or apparatus to read out and execute the program code stored in the storage medium.

In this case, the program code itself read from the storage medium realizes the functions of the above-described embodiment, and therefore the program code and the storage medium in which the program code is stored constitute the present invention.

Examples of the storage medium for supplying the program code include a floppy (registered trademark) disk, a hard disk, a magnetic-optical disk, a CD-ROM, a CD-R, a CD-RW, a DVD-ROM, a DVD-RAM, a DVD-RW, a DVD+

RW, a magnetic tape, a nonvolatile memory card, and a ROM. Alternatively, the program may be downloaded via a network.

Further, it is to be understood that the functions of the above-described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

The above-described embodiments are merely exemplary of the present invention, and are not be construed to limit the scope of the present invention.

The scope of the present invention is defined by the scope of the appended claims, and is not limited to only the specific descriptions in this specification. Furthermore, all modifications and changes belonging to equivalents of the claims are considered to fall within the scope of the present invention.

This application claims the benefit of Japanese Patent Application No. 2005-252343 filed Aug. 31, 2005, which is hereby incorporated by reference herein in its entirety.

What is claimed is:

1. A sheet conveying system comprising:

an upstream sheet conveying apparatus that conveys a sheet; and a downstream sheet conveying apparatus capable of communicating with said upstream sheet conveying apparatus, and that receives the sheet from said upstream sheet conveying apparatus, wherein said downstream sheet conveying apparatus having a first sheet conveying unit that conveys the sheet, and said upstream sheet conveying apparatus having a second sheet conveying unit that conveys the sheet and passes the sheet to said downstream sheet conveying apparatus, wherein said upstream sheet conveying apparatus includes an abnormality detecting unit that detects occurrence of an abnormality in the conveyance of the sheet in said upstream sheet conveying apparatus, a passing completion-detecting unit that detects completion of passage of the sheet to said downstream sheet conveying apparatus, a notification unit that notifies said downstream sheet conveying apparatus of first information indicating a result of the detection by said abnormality detecting unit and second information indicating a result of the detection by said passing completion-detecting unit, and an upstream sheet suspension unit that suspends the conveyance of the sheet in said upstream sheet conveying apparatus when said abnormality detecting unit detects the occurrence of the abnormality, and wherein said downstream sheet conveying apparatus includes a receiving unit that receives the first and second information from said notification unit, a first determining unit that determines whether or not said abnormality detecting unit detects the abnormality based on the first information received by said receiving unit, a second determining unit that determines whether or not said passing completion-detecting unit detects the completion based on the second information received by said receiving unit, a downstream sheet suspension unit that suspends the conveyance of the sheet in said downstream sheet conveying apparatus, and a control unit that controls said downstream sheet suspension unit to suspend the conveyance in a case where said first determining unit determines that said abnormality detecting unit detects the abnormality and said second determining unit determines that said passing completion-detecting unit detects the completion, while controlling the first sheet conveying unit to keep conveying the sheet in all other cases.

2. The sheet conveying system as claimed in claim 1, wherein said downstream sheet suspension unit suspends the conveyance of the sheet by stopping the conveyance of the sheet.

3. The sheet conveying system as claimed in claim 1, wherein said downstream sheet conveying apparatus includes a stack tray and an escape tray, and wherein said downstream sheet suspension unit suspends the conveyance of the sheet toward the stack tray by discharging the sheet onto the escape tray.

4. A method of controlling a sheet conveying system that includes an upstream sheet conveying apparatus that conveys a sheet; and a downstream sheet conveying apparatus capable of communicating with said upstream sheet conveying apparatus, and that receives the sheet from said upstream sheet conveying apparatus, wherein said downstream sheet conveying apparatus having a first sheet conveying unit that conveys the sheet, and said upstream sheet conveying apparatus having a second sheet conveying unit that conveys the sheet, and passes the sheet to said downstream sheet conveying apparatus, the method comprising:

an abnormality-detecting step of detecting occurrence of an abnormality in the conveyance of the sheet in said upstream sheet conveying apparatus;

a passing completion-detecting step of detecting completion of passage of the sheet from said upstream sheet conveying apparatus to said downstream sheet conveying apparatus; and a notification step in which said upstream sheet conveying apparatus notifies said downstream sheet conveying apparatus of first information indicating a result of the detection in said abnormality-detecting step and second information indicating a result of the detection in said passing completion-detecting step;

an upstream sheet suspension step of suspending the conveyance of the sheet in said upstream sheet conveying apparatus when said abnormality detecting step detects the occurrence of the abnormality;

a receiving step in which said downstream sheet conveying apparatus receives the first and second information in said notification step;

a first determining step of determining whether or not said abnormality detecting step detects the abnormality based on the first information received in said receiving step;

a second determining step of determining whether or not said passing completion-detecting step detects the completion based on the second information received in said receiving step;

a downstream sheet suspension step of suspending the conveyance of the sheet by said downstream sheet conveying apparatus; and a control step of controlling said downstream sheet suspension step to suspend the conveyance in a case where said first determining step determines that said abnormality detecting step detects the abnormality and said second determining step determines that said passing completion-detecting step detects the completion while controlling the first sheet conveying unit to keep conveying the sheet in all other cases.

5. The control method as claimed in claim 4, wherein said downstream sheet suspension step suspends the conveyance of the sheet by stopping the conveyance of the sheet.

6. The control method as claimed in claim 4, wherein said downstream sheet conveying apparatus includes a stack tray and an escape tray and wherein said downstream sheet suspension step suspends the conveyance of the sheet toward the stack tray by discharging the sheet onto the escape tray.

* * * * *

UNITED STATES PATENT AND TRADEMARK OFFICE

CERTIFICATE OF CORRECTION

PATENT NO. : 7,909,324 B2
APPLICATION NO. : 11/468459
DATED : March 22, 2011
INVENTOR(S) : Toshiyuki Miyake et al.

It is certified that error appears in the above-identified patent and that said Letters Patent is hereby corrected as shown below:

On the Title Page

Item (75) Inventors

REMOVE: Tokyo

INSERT -- Toshima-ku --

Signed and Sealed this
Tenth Day of May, 2011

David J. Kappos

David J. Kappos
*Director of the United States Patent and Trademark Office*